US006951491B2

(12) United States Patent
Sakaguchi et al.

(10) Patent No.: US 6,951,491 B2
(45) Date of Patent: Oct. 4, 2005

(54) CONNECTION CAP AND WIRE CONNECTION METHOD USING SAME

(75) Inventors: Tadahisa Sakaguchi, Haibara-gun (JP); Masanori Onuma, Haibara-gun (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/825,677

(22) Filed: Apr. 16, 2004

(65) Prior Publication Data

US 2004/0253857 A1 Dec. 16, 2004

(30) Foreign Application Priority Data

Jun. 12, 2003 (JP) ..... P2003-167875

(51) Int. Cl.[7] ..... H01R 4/10; H01R 4/28

(52) U.S. Cl. ..... 439/879; 439/877; 439/760

(58) Field of Search ..... 439/879, 877, 439/883, 783, 756, 760, 773

(56) References Cited

U.S. PATENT DOCUMENTS 5,191,710 A * 3/1993 Fujimaki et al. ..... 29/863
5,445,535 A * 8/1995 Phillips et al. ..... 439/394
6,098,443 A * 8/2000 Muller et al. ..... 72/412
6,781,060 B2 * 8/2004 Radley ..... 174/84 R
6,831,230 B2 * 12/2004 Ide et al. ..... 174/84 R
2002/0038511 A1 * 4/2002 Kuwayama et al. ..... 29/861

FOREIGN PATENT DOCUMENTS

JP 10-243539 9/1998

* cited by examiner

*Primary Examiner*—Chandrika Prasad
(74) *Attorney, Agent, or Firm*—Sughrue Mion, PLLC

(57) ABSTRACT

A connection cap includes: an insulative cap body for receiving conductors of a wire provided with a back wall and an opening at respective opposite ends thereof; an electrically-conductive conductor connection member which is provided within the cap body and is adapted to be connected to the conductors when the cap body is compressed radially in a state the conductors are received in the cap body; and an electrically-conductive resin material which is filled in a back wall-side portion of the cap body, and is extruded toward the opening to penetrate into interstices between the conductors when the cap body is compressed.

8 Claims, 4 Drawing Sheets

10
33
33a
33b
13a
13
12
15
14
20
24
26
26a
26b
26

CONNECTION CAP AND WIRE CONNECTION METHOD USING SAME

BACKGROUND OF THE INVENTION

This invention relates to a connection cap for insulating and protecting conductors of a wire from the exterior and for joint-connecting the conductors of the wires together, and also relates to a wire connection method using this connection cap.

As one example of related connection caps of this kind as well as one example of wire connection methods using it, there is known one which has been proposed by the Applicant of the present application, and is shown in FIG. 7 (For example, Patent Literature 1).

This related example provides the connection cap 50 excellent in connecting-operation efficiency and waterproofness, and also provides the wire connection method using it. The connection cap 50 comprises a cap body 51 for the insertion of distal end portions of a plurality of wires 59 thereinto, and an insulative seal layer 56 which is filled in the cap body 51, and penetrates into a gap between conductors 59*a* and the cap body 51 and also into interstices between sheaths 59*b*.

The wires 59 are so-called splice wires each having the conductors 59*a* exposed by removing the sheath 59*b*. The conductors 59*a* are beforehand joined together by any of various methods, such as press-fastening, soldering, welding and thermal press-fastening, before these conductors are inserted into the cap body 51. The cap body 51 is made of an insulative synthetic resin such as polyvinyl chloride, polyethylene or polypropylene, and has such a configuration that a closed back wall 52 is provided at its distal end and that an opening 53 for the insertion of the end portions of the wires 59 therethrough is provided at its rear end.

A holder plate 55 for fixing the wires is formed at the open end of the cap body 51, and projects therefrom in a direction opposite to the direction of insertion of the wires 59. This holder plate 55 serves to prevent the withdrawal of the connection cap 50, and the holder plate 55 is held against the wires 59, and a tape 57 is wound on the wires 59, including the holder plate 55, thereby fixing the connection cap 50.

The seal layer 56 is formed by curing an uncured resin such as an epoxy resin and a polyurethane resin having insulating and waterproof properties. The uncured resin, having the viscosity of 100 to 5000 centipoise (0.1 to 5 Pa·s), is used so that it can penetrate into a gap between the conductors 59*a* and the cap body 51 and also into the interstices between the sheaths 59*a*.

When the wires 59 are to be connected to the connection cap 50, the uncured resin is poured into the connection cap 50, and then the wires 59 are inserted thereinto. As a result, the uncured resin penetrates into the gap between the conductors 59*a* ad the cap body 51*a*, the interstices between the sheaths 59*b* and the interstices between the conductors 59 because of a capillary phenomenon. Then, the connection cap 50 is held at a temperature of 20 to 60° C. for 2 to 30 minutes, so that the uncured resin is cured, and the wires 59 are connected to the connection cap 50.

Patent Literature 1

JP-A-10-243539 Publication

However the above related connection cap 50 and the wire connection method, using it, have the following problems to be solved.

Firstly, the process of connecting the wires 59 to the connection cap 50 comprises the joint step of joining the conductors 59*a* of the wires 59 by press-fastening, welding or the like, the insulating and waterproofing step of inserting the conductors 59 into the cap body 51 filled with the uncured resin (serving as a sealant) and penetrating the uncured resin into the interstices between the conductors 59*a* of the wires 59, the curing treatment step of curing the uncured resin under the predetermined conditions, and the tap winding step of winding the tape 57 on the wires 59, including the holder plate 55. The wire-connecting operation was carried out via many steps, and therefore there were encountered problems that much time was required and that the cost was high.

And besides, there was a fear that when the conductors 59*a* were merely immersed in the uncured resin, the uncured resin could not completely penetrate into the gap between the conductors 59*a* and the cap body 51, the interstices between the sheaths 59*b* and the interstices between the conductors 59*a*. When the viscosity of the uncured resin was lowered so that it could completely penetrate, there was a fear that the uncured resin leaked out of the opening 53 of the connection cap 50.

Furthermore, when the gap between the wires 59, inserted in the connection cap 50, and the connection cap 50 was large, it took much time for the uncured resin to be cured, and a yield decrease is encountered in the curing treatment step, and besides there was a fear that after the curing of the resin, the wires 59 within the connection cap 50 were moved by an accidental external force, so that cracks or the like developed in the seal layer 56, thus adversely affecting the waterproof ability, and water or the like intruded into the connection cap 50.

SUMMARY OF THE INVENTION

In view of the above points, it is an object of this invention to provide a connection cap, as well as a wire connection method using it, in which by effecting the connection of conductors of wires, an insulating/waterproofing treatment for the conductors and a treatment of water-stop between the wires (sheaths) simultaneously, the number of the process steps is reduced, and the processing time is shortened, so that the efficiency of the wire-connecting operation can be enhanced, and the insulating performance of the conductors can be maintained and secured, and the highly-reliable electrical performance can be obtained.

In order to solve the aforesaid object, the invention is characterized by having the following arrangement.

(1) A connection cap comprising:

an insulative cap body for receiving conductors of a wire provided with a back wall and an opening at respective opposite ends thereof;

an electrically-conductive conductor connection member which is provided within the cap body and is adapted to be connected to the conductors when the cap body is compressed radially in a state the conductors are received in the cap body; and an electrically-conductive resin material which is filled in a back wall-side portion of the cap body, and is extruded toward the opening to penetrate into interstices between the conductors when the cap body is compressed.

(2) The connection cap according to (1), wherein the cap body is made of a polyamide resin material.

(3) The connection cap according to (1), wherein the electrically-conductive resin material includes a thermosetting resin material comprising an epoxy resin as a base component, electrically-conductive particles and curing agent.

(4) The connection cap according to (1), wherein the cap body is made of transparent or translucent material.

(5) The connection cap according to (1), wherein the electrically-conductive resin material has the viscosity of 3 to 30 Pa·s.

(6) A method of processing a wire including conductors using a connection cap including an insulative cap body for receiving conductors provided with a back wall and an opening at respective opposite ends thereof; an electrically-conductive conductor connection member which is provided within the cap body; and an electrically-conductive resin material which is filled in a back wall-side portion of the cap body, the method comprising the steps of:

inserting the conductors into the cap body; and compressing the cap body by a rotary waging machine so that the conductor connection member is retained to the cap body and is pressed fastened to the conductors, whereby the conductors are connected to the connection cap.

(7) The method according to (6), wherein the connection cap is compressed while the connection cap is gradually inserted between opposed dies of the rotary swaging machine, with a distal end thereof first introduced therebetween.

(8) The method according to (7), wherein the dies include, at opening-sides, tapering approach portions, respectively, and the connection cap is inserted between the dies while being guided by the approach portions.

DETAILED DESCRIPTION OF PREFERRED EMBODIMENTS

Figure 1:
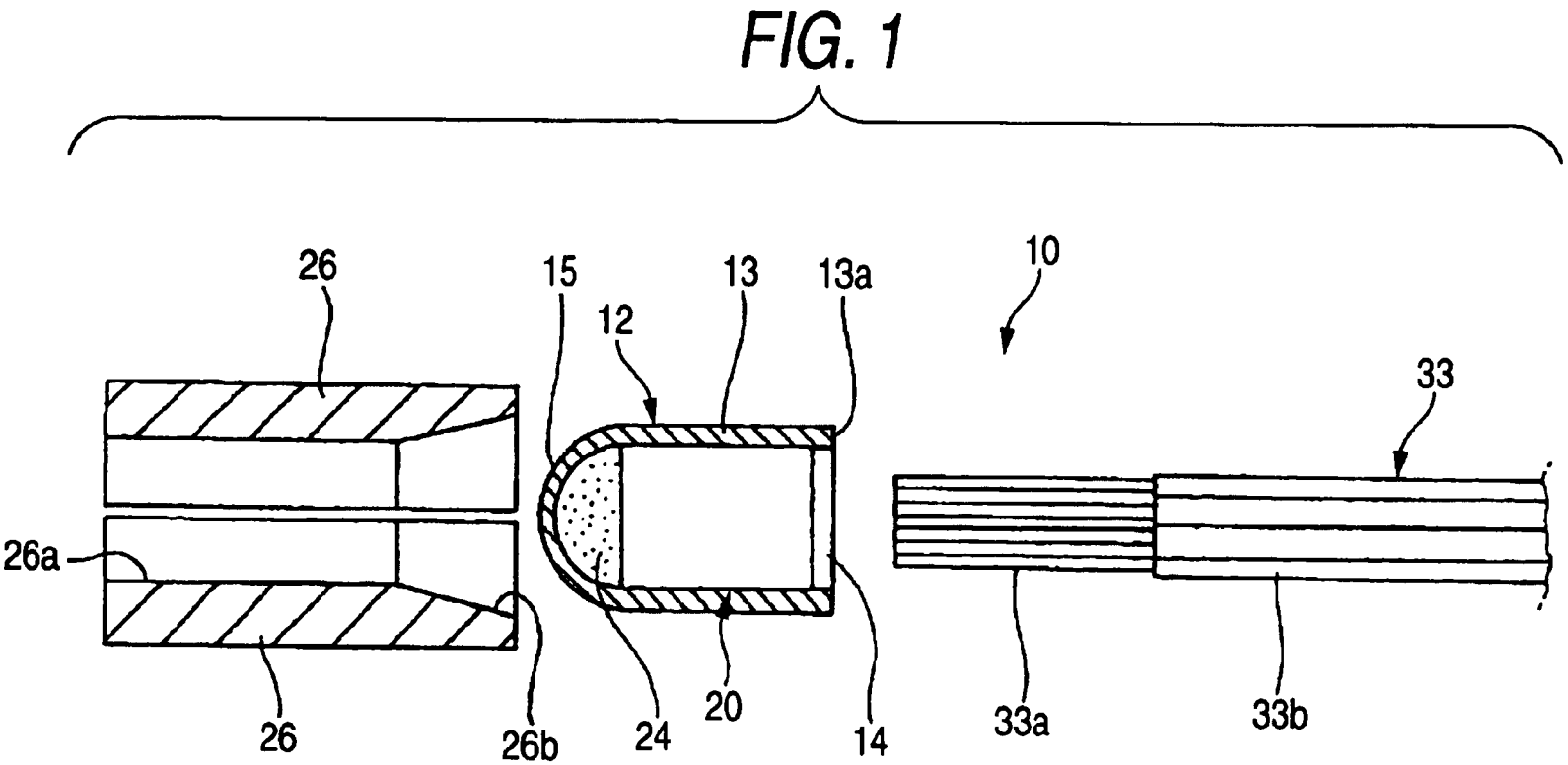
FIG. 1 is an exploded view showing one embodiment of a connection cap of the present invention.

A specific example of an embodiment according to the present invention will now be described in detail with reference to the drawings.

In one embodiment of the present invention of FIGS. 1 to 5, a connection cap 10 is a connection part which joint-connects conductors 33*a* of a wire 33 extending from circuit elements (forming an electric circuit) or the like, and insulates and protects the conductors 33*a*. The wire 33 to be connected are, for example, wire extending from a plurality of actuators such as a motor and a solenoid, branch wire branching off from a main wire portion of a wire harness, wire connected to electronic parts to be received within an electric connection box, wire connected to a battery or the like, and so on. The number of the wire to be connected increases or decreases according to the form of circuit, and in this embodiment the conductors 33*a* of seven wire 33 are joint-connected together by the connection cap 10.

A sheath 33*b* is removed from an end portion of each of the wire 33 to be connected, so that the conductors 33*a* are exposed over a desired length. The exposure length of the conductors 33*a* is slightly smaller than the depth of the connection cap 10. Therefore, the connection cap 10 can be held in intimate contact with the sheaths 33*b* at an open end portion 13*a* thereof, so that water is prevented from intruding into the interior of the connection cap 10. The conductors 33*a* of the wire 33 are arranged in the same direction, and are suitably twisted together, and are inserted deep into the connection cap 10 through an opening 14 thereof.

The present invention provides the connection cap 10, as well as a wire connection method using it, in which by effecting the joint-connection of the conductors 33*a* of wire 33, an insulating/waterproofing treatment for the conductors and a treatment of water-stop between the wire 33 simultaneously, the number of the process steps is reduced, and the processing time is shortened, so that the processing cost can be reduced, and besides the highly-reliable electrical connection can be achieved. The connection cap 10 is characterized in that this cap comprises an insulative cap body 12 which has a closed back wall 15 of a generally hemispherical shape formed at a distal end thereof, and has at a rear end thereof the opening 14 for the insertion of the conductors 33*a* of the wire 33 therethrough, a sleeve (conductor connection member) 20 which is inserted into the interior of the cap body 12, and is pressed into a peripheral wall (wall portion) 13 of the cap body 12 to be retained relative thereto, and also is connected to the conductors 33*a* of the plurality of wire 33 when the cap body 12 is compressed radially, and an electrically-conductive resin material 24 which is filled in that portion of the cap body 12 disposed adjacent to the back wall 15, and is extruded to penetrate into the interstices between the conductors 33*a* of the wire 33 when the cap body 12 is compressed, and that the cap body 12 is made of a polyamide resin material which is softer than the sleeve 10 made of metal. The present invention is not limited to the construction in which the sleeve 20 is formed separately from the cap body 12, but the sleeve 20 may be formed integrally with the cap body 12 by insert molding.

A seal layer 23 is formed by the cured thermosetting resin material comprising an epoxy resin as a base component and electrically-conductive particles added thereto. The interstices between the conductors 33*a* are sealed by the resin, and the contact resistance of the conductors 33*a* is reduced by the electrically-conductive particles. The curing temperature and curing time of the resin material change, depending on the kind and amount of an added curing agent, and in this embodiment the kind and amount of the curing agent are so determined that the resin material can be cured in a short time at a temperature of 60 to 90° C.

The wire connection method, using the connection cap 10, is characterized in that after the conductors 33*a* of the plurality of wire 33 are inserted into the cap body 12, the cap body 12 is compressed uniformly at its periphery while it is gradually inserted between a pair of opposed dies 26 and 26 of a rotary swaging machine 25 (shown in FIG. 6), with its distal end first introduced therebetween, thereby pressing the sleeve 20 into the cap body 12 to retain the sleeve relative to the cap body while press-fastening the conductors 33*a* and the sleeve 20 to each other, so that the plurality of wire 33 are connected to the connection cap 12. This method is also characterized in that tapering approach portions 26*b* are formed respectively at opening-sides of the pair of dies 26 and 26 and that the connection cap 10, while guided by these approach portions 26*b*, is inserted.

The main constituent portions of the connection cap 10 of this embodiment will be described below in detail, and then the construction of the rotary swaging machine 25 and the wire connection method, using the connection cap 10, will be described sequentially.

As shown in FIG. 1, the connection cap 10 comprises the insulative cap body 12, the electrically-conductive sleeve 20, and the electrically-conductive resin material 24. The cap body 12 is molded by injection molding, using a transparent or a translucent polyamide resin material as a constituent material. The cap body 12 is transparent or translucent so that whether or not the connected condition of the conductors 33*a* and sleeve 20 is good can be recognized at a glance. However, the present invention is not limited to the use of such transparent or translucent cap body 12, but the connection cap 10 can be formed, using an opaque cap body 12.

The polyamide resin material is a resin material which is excellent in heat resistance, impact resistance and elasticity, and is less susceptible to brittle fracture. Therefore, even when the metallic sleeve 20 is pressed into the cap body 12, and the cap body 12 is elongated in the axial direction upon compression of the cap body 12 by the rotary swaging machine 25, any crack will not develop in the cap body 12, and also any fracture will not develop therein.

The distal end of the cap body 12 is formed as a closed end at which the generally-hemispherical back wall 15 is formed, and the intrusion of water through this distal end is completely prevented. Since the back wall 15 is formed into a generally-hemispherical shape, the connection cap 10 can be smoothly inserted between the opposed dies 26 and 26 of the rotary swaging machine (described later) without being caught.

The rear end of the cap body 12 is formed as an open end, and the conductors 33*a* of the wire 33 can be inserted therethrough. The holder plate 55 on which the tape 57 can be wound in the related example is not formed at the open end portion 13*a*. The reason is that without the holder plate 55, the connection cap 10 can be secured to the wire 33 by the press-fastening force, and will not be withdrawn therefrom.

The interior of the cap body 12 is a receiving space 17 (FIG. 2) for the conductors 33*a*, and the conductors 33*a* can be insulated and protected by the cap body 12. The inner diameter of the cap body 12 is slightly larger than the outer diameter of the tubular sleeve 20 so that the sleeve 20 can be smoothly inserted deep thereinto through the opening 14. The depth of the cap body 12 is larger than the length of the sleeve 20, and when the sleeve 20 is inserted into the cap body 12, spaces are formed respectively at the distal and rear ends of the sleeve 20.

Figure 2:
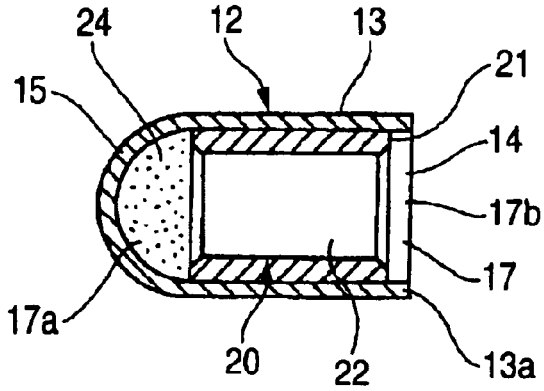
FIG. 2 is a cross-sectional view showing the connection cap of FIG. 1.

As shown in FIG. 2, the distal end-side space is a filling portion 17*a* for the uncured electrically-conductive resin material 24 which is filled in the cap body 12 to form the seal layer 23. The rear end-side space is a sheath-clamping portion 17*b* for press-fastening on the sheaths 33*b* of the wire 33. The sheath-clamping portion 17*b* is elongated in the axial direction upon compression, and therefore an area of contact between the sheaths 33*b* and the sheath-clamping portion 17*b* can be secured without the need for increasing the length of the open end portion of the cap body 12.

Figure 3:
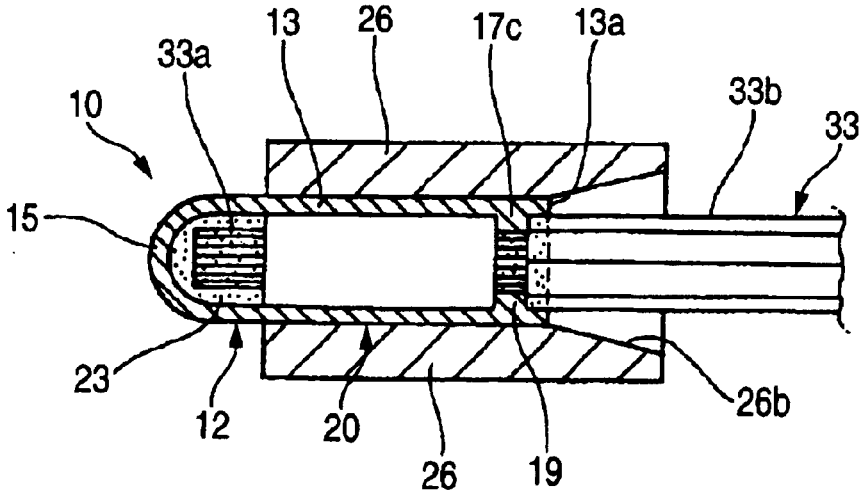
FIG. 3 is a partly cross-sectional view showing a processing condition of the connection cap.

At the end of the cap body 12 having the opening 14, the end surfaces of the sheaths 33*b* are opposed to the rear end surface of the sleeve 20, with a gap 17*c* formed therebetween (FIG. 3). This gap 17*c* is a space which is closed by part of the peripheral wall (wall portion) 13 of the cap body 12 which flows when the sleeve 20 is pressed into the cap body 12 upon compression of the cap body 12 by the rotary swaging machine 25. When part of the peripheral wall 13 of the cap body 12 intrudes into the gap 17*c*, so that an annular convex portion 19 is formed on the inner surface of the cap body 12, the sleeve 20 abuts at its rear end against this annular convex portion 19, and therefore is prevented from withdrawal from the cap body 12.

The sleeve 20 (FIG. 2) is a tubular member made of an electrically-conductive metallic material such as copper, and has a bore therethrough so that the conductors 33*a* of the wire 33 can pass through the sleeve from one end thereof to the other end thereof. The inner diameter of the sleeve 20 is larger than the outer diameter of the conductors 33*a*. A tapering surface 21 is formed at an open end of the sleeve 20. Therefore, the conductors 33*a* to be inserted into the sleeve 20 can be smoothly passed therethrough without being caught by this open end. The sleeve 20 is not limited to the tubular member, but can be replaced by a connection member having a pair of press-clamping piece portions formed respectively at opposite side portions thereof, or can be replaced by a connection member of a C-shaped cross-section having an axial slit.

The sleeve 20 is inserted deep into the cap body 12 through the opening 14, and an adhesive can be beforehand coated on the inner surface of the cap body 12 so that the sleeve 20, once inserted in the cap body, will not be withdrawn therefrom. In this case, the type of adhesive, having an adhesive force at ordinary temperature, is used as the adhesive to be coated.

The thermosetting electrically-conductive resin material 24, which is filled in the cap body 12 to form the seal layer 23 at the interstices between the conductors 33*a* and also at the interstices between the sheaths 33*b*, comprises the epoxy resin (such as a bisphenol A type or a novolak type), the electrically-conductive particles (such as gold, silver, nickel, copper or carbon), and the curing agent (such as dicyandiamide, hexamethylenetetramine, a derivative of imidazole or amine of boron trifluodide).

Preferably, the electrically-conductive resin material 24, having the viscosity of 3 to 30 Pa·s (For information, the viscosity of water is $1\times10^{-3}$ Pa·s) is used. If the viscosity is too low, there are encountered problems that a long time is required for the curing, so that the efficiency of the wire-connecting operation is lowered and that the resin drips from the open end 13*a* of the cap body 12. On the other hand, if the viscosity is too high, there is encountered a problem that the fluidity is lowered, so that much time is required for filling (pouring) the resin in the cap body, and the handleability is worsened.

The kind and amount of the uncured electrically-conductive resin material 24, filled in the cap body 12, are so determined that this resin can be cured by frictional heat produced by the dies 26 and the cap body 12. In this embodiment, the curing temperature is set to 60 to 90° C. so that the resin can be cured in a short time after the connection cap 10 is stricken about several hundreds times by the dies 26.

Figure 6:
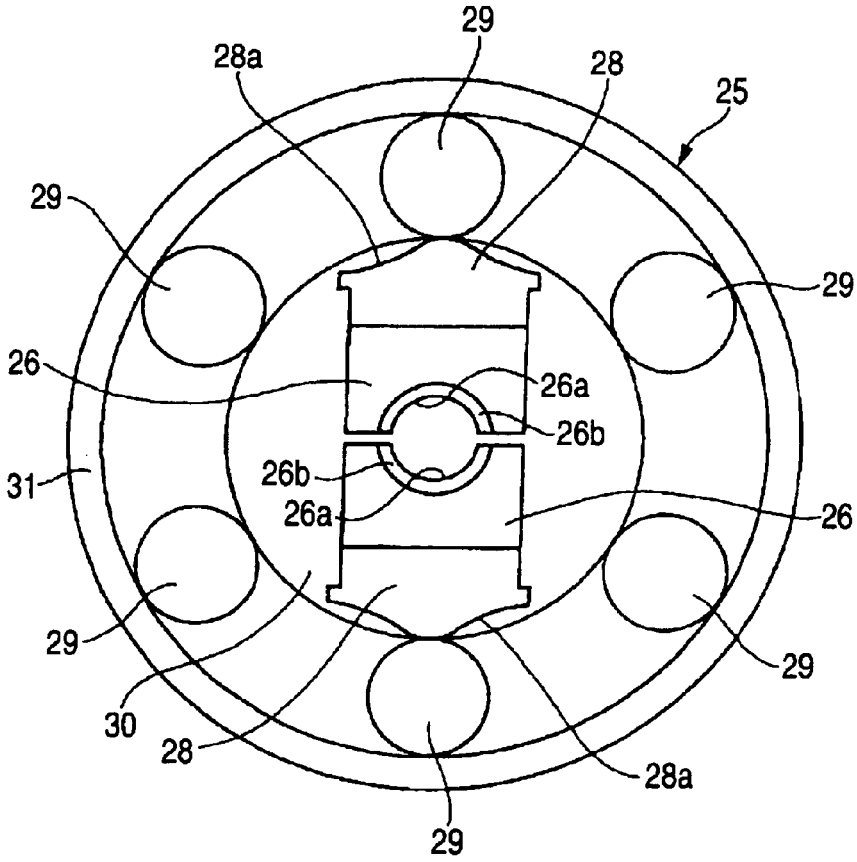
FIG. 6 is a front-elevational view of a main portion of a rotary swaging machine for compression-shaping the outer periphery of the connection cap.
Figure 7:
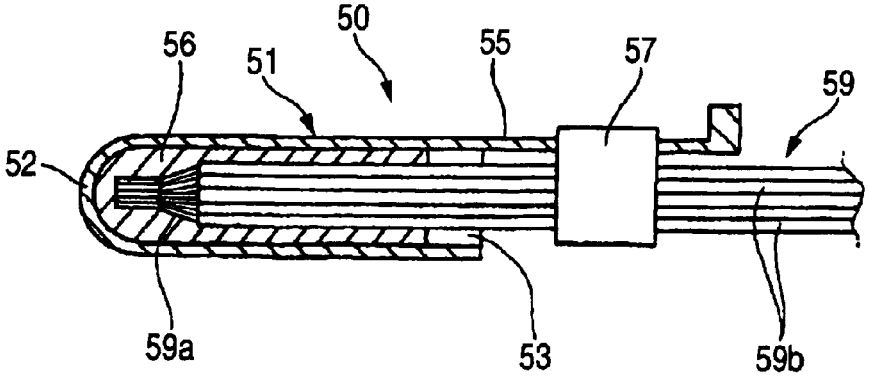
FIG. 7 is a partly cross-sectional view showing one example of related connection cap.

Next, the main constituent portions of the rotary swaging machine 25, used for compressing the connection cap 10, will be described with reference to FIG. 6 and others.

The dies 26 and buckers 28 are movably held within a spindle 30 of the rotary swaging machine 25 in such a manner that the dies are held in contact with the buckers, respectively. In this embodiment, there are provided the pair of opposed dies 26 and 26. The connection cap 10 (which is a work) is located at the center of the spindle 30 in such a manner that this connection cap is held between inner surfaces 26*a* of the dies 26 (It is not shown in FIG. 6. See FIG. 1 or others). The connection cap 10 is thus located at the axis of rotation of the spindle 30 so that the outer surface of the connection cap 10 can be stricken uniformly over the entire periphery thereof.

The tapering approach portions 26*b* are formed respectively at the rear end portions of the dies 26 (those sides for the insertion of the connection cap 10) (see FIGS. 1 and 3), and the connection cap 10, while guided by these approach portions 26*b*, is gradually compressed in such a manner that this compression proceeds sequentially from the distal end portion of the connection cap. Therefore, the connection cap 10 is smoothly inserted between the dies 26 with a low insertion force, and a force, tending to push the sleeve 20 toward the opening of the cap body 12, is reduced, thereby preventing the withdrawal of the sleeve 20. And besides, the electrically-conductive resin material 24, filled in the filling portion 17*a* of the cap body 12, is gradually extruded toward the opening 14 of the cap body 12, and is filled uniformly in (penetrates into) the interstices between the conductors 33*a* and also in the interstices between the sheaths 33*b*, thereby preventing water, flowing along the wire 33, from intruding into the cap body 12.

Although the buckers 28, arranged radially outwardly of the respective dies 26, are separate respectively from the dies 26, each bucker can revolve in cooperation with the die 26, and can move in the radial direction (toward the center). The revolution can be effected by rotating the spindle 30 by a motor (not shown). The movement in the radial direction is effected by rotational contact between the bucker 28 and a roller 29.

An outer peripheral surface of the bucker 28 is formed into a cam surface 28*a*. This cam surface 28*a* is not formed into a constant radius of curvature, but a widthwise-central portion thereof projects radially outwardly. Therefore, when the bucker 28 is brought into rotational contact with the roller 29, the bucker 28 is forced inward in the radial direction by the roller 29 by an amount corresponding to the amount of projecting of the central portion, thereby moving the die 26 in the radial direction.

The spherical rollers 29 are arranged at equal intervals, and are provided between the outer periphery of the spindle 30 and an outer ring 31, and are rotatably supported. Although the number of the rollers 29 is 6, it may be 8. The larger the number of the rollers 29 is, the larger the number of blows per rotation of the spindle is, so that the processing rate of the connection cap 10 increases. The connection cap 10 is stricken at least several hundreds times by the dies 26.

The rotary swaging machine 25 operates in the following. When the spindle 30 is rotated, the dies 26 and the buckers 28 revolve, and also the rollers 29 rotate. The buckers 28 are disposed radially outwardly of the dies 26, and therefore each revolving bucker 28 is brought into contact with the roller 29, and the cam surface 28*a* of the bucker 28 runs on the roller 29, so that an inner surface of the bucker 28 forces the die 26 radially inwardly, thereby causing the die 26 to strike against the connection cap 10.

When each bucker 28 is brought out of contact with the roller 29, the bucker 28 slightly springs out radially outwardly by a centrifugal force, so that the die 26 moves apart from the connection cap 10, and the striking by the die 26 is once stopped. Again, each bucker 28 is brought into contact with the roller 29, and the above operation is repeated.

Figure 4:
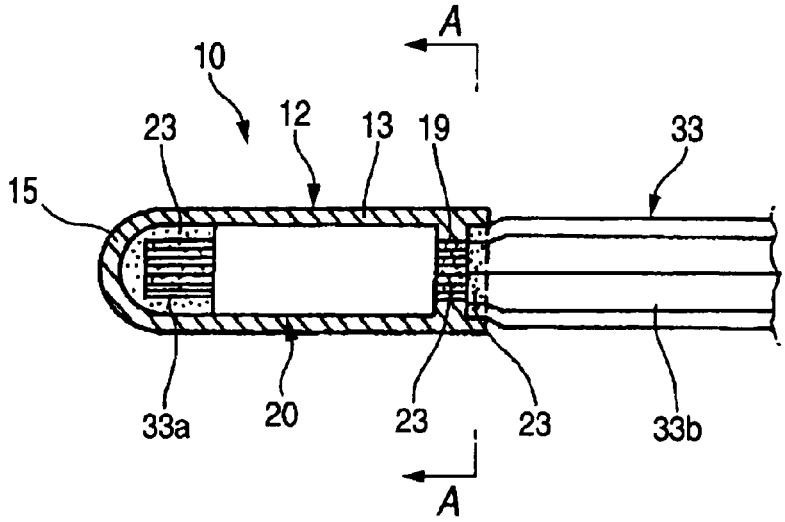
FIG. 4 is a plan view showing the connection cap and the wire after the processing.
Figure 5:
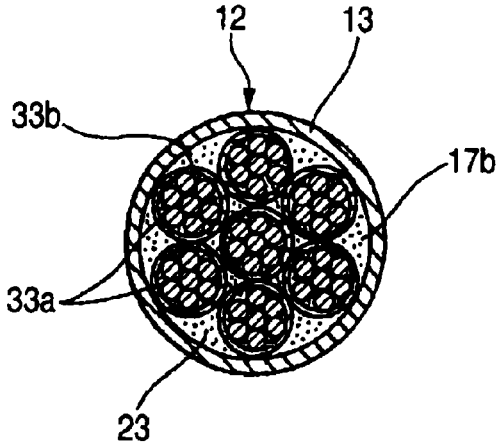
FIG. 5 is a cross-sectional view taken along the line A-A of FIG. 4.

Next, the wire connection method, using the connection cap 10, will be described with reference to FIGS. 3 to 5.

First, a set of (seven) wire 33 are arranged such that their ends are disposed flush with one another, and in this condition the sheath 33*b* is removed from each wire 33, thereby exposing the conductors 33*a* over a predetermined length. The conductors 33*a* are suitably twisted together slightly so that the plurality of wire elements will not become loose, and then the conductors are inserted deep into the connection cap 10 through the opening 14. The wire 33 are inserted until the conductors 33*a* passes through the sleeve 20, so that the distal ends of the conductors 33*a*, projecting out of the sleeve 20, abut against the back wall 15. When the conductors 33*a* abut against the back wall 15, the rear end surface of the sleeve 20 is opposed to the end surfaces of the sheaths 33*b*, with the gap 17*c* formed therebetween. Part of the peripheral wall 13 of the cap body 12 intrudes into this gap 17*c* during the compression operation, thereby preventing the withdrawal of the sleeve 20.

After the conductors 33*a* of the plurality of wire 33 are inserted into the cap body 12, the cap body 12 is gradually inserted between the pair of dies 26 and 26 of the rotary swaging machine 25, with its distal end first introduced therebetween (FIG. 3). As a result, the electrically-conductive resin material 24, filled in the cap body 12, is extruded toward the opening to penetrate into the interstices between the conductors 33*a* and also between the interstices between the sheaths 33*b*, while the peripheral wall 13 of the cap body 12 is uniformly compressed by the pair of dies 26 and 26, and the sleeve 20 is pressed into the cap body 12 to be retained relative to this cap body, and the conductors 33*a* are press-fastened to the sleeve 20, and the electrically-conductive resin material 24 fills in the interstices between the conductors 33*a* and also in the interstices between the sheaths 33*b*, and is cured. Incidentally, a suitable amount of electrically-conductive resin material 24 is filled in the cap body 12 so that it will not leak to the exterior through the opening 14 of the cap body 12.

With this construction, the cap body 12 and the sleeve 20 are simultaneously compressed by the rotary swaging machine 25, so that the joint connection of the conductors 33*a* and the insulating/waterproof treatment for the conductors are effected simultaneously, and therefore the efficiency of the operation for connecting the connection cap 10 is enhanced. And besides, the cap body is stricken about several hundreds times by the dies 26, and the electrically-conductive resin material 24, filled in the cap body 12, is cured in a short time by frictional heat produced at this time, so that the seal layer 23 is formed in the interstices between the conductors 33*a* and also in the interstices between the sheaths 33*b*. Because of the difference in hardness between the cap body 12 and the sleeve 20, the sleeve 20 is pressed into the cap body 12, and therefore the sleeve 20 is prevented from withdrawal from the cap body 12.

The present invention is not limited to the above embodiment, and various modifications can be made without departing from the subject matter of the invention.

As described above, according to the invention, after the conductors of the plurality of wire are inserted deep into the cap body through the opening thereof, the wall portion of the cap body is compressed radially, and by doing so, the conductor connection member is pressed into the cap body (made of the soft material) to be retained relative thereto, and the conductors are electrically connected to the conductor connection member, and also the conductors of the wire are joint-connected together. When the wall portion of the cap body is compressed radially, the electrically-conductive resin material, filled in the back wall-side portion of the cap body, is extruded from the back wall-side portion of the cap body toward the opening thereof to penetrate into the interstices between the conductors and also into the interstices between sheaths. Therefore, the conductor connection member is prevented from withdrawal from the cap body, and the wire are insulated and protected in a waterproof manner by the cap body, so that the reliability of the electrical connection is enhanced.

According to the invention, the polyamide resin can be easily deformed, and has good processability, and will not be subjected to cracks or the like, and therefore when the cap body is compressed radially, the conductor connection member can be easily pressed into the cap body. Therefore, the withdrawal of the conductor connection member from the cap body is positively prevented.

According to the invention, the seal layer has high electrical conductivity and a high adhesive strength, and therefore the contact resistance of the conductors is reduced, and besides the interstices between the conductors are completely closed. Therefore, the electrical performance of the conductors is enhanced, and also the waterproof ability is enhanced.

According to the invention, the rotary swaging machine is used for compressing the connection cap, and therefore the cap body is uniformly compressed radially, and the concentration of localized stresses is avoided, and also the electrically-conductive resin material is smoothly extruded to fill uniformly in the interstices between the conductors, and also is cured by frictional heat, produced during the compression, to form the seal layer. Because of the difference in hardness between the cap body and the conductor connection member, the conductor connection member is pressed into the cap body, and is prevented from withdrawal therefrom, and the joint connection of the conductors and the insulating/waterproofing treatment of the conductors are simultaneously effected in one step. Therefore, the efficiency of the wire connecting operation, as well as the processability of the connection cap, is greatly enhanced as compared with the related construction. And besides, the insulating and waterproofing ability is enhanced, and also the reliability of the electrical connection is enhanced.

According to the invention, the electrically-conductive resin material is gradually extruded from the back wall-side portion of the cap body toward the open end thereof, and is filled uniformly in the interstices between the conductors. Therefore, the waterproof ability is enhanced, and also the conductors contact one another via the electrically-conductive particles, so that the contact resistance is reduced.

According to the invention, the force, tending to push the conductor connection member toward the opening of the cap body, is reduced, and the connection cap can be smoothly inserted between the dies with a low insertion force. Therefore, the efficiency of the wire connecting operation is enhanced.

What is claimed is:

1. A connection cap comprising:

an insulative cap body for receiving conductors of a wire provided with a back wall and an opening at respective opposite ends thereof;

an electrically-conductive conductor connection member which is provided within the cap body and is adapted to be connected to the conductors when the cap body is compressed radially in a state the conductors are received in the cap body; and an electrically-conductive resin material which is filled in a back wall-side portion of the cap body, and is extruded toward the opening to penetrate into interstices between the conductors when the cap body is compressed.

2. The connection cap according to claim 1, wherein the cap body is made of a polyamide resin material.

3. The connection cap according to claim 1, wherein the electrically-conductive resin material includes a thermosetting resin material comprising an epoxy resin as a base component, electrically-conductive particles and curing agent.

4. The connection cap according to claim 1, wherein the cap body is made of transparent or translucent material.

5. The connection cap according to claim 1, wherein the electrically-conductive resin material has the viscosity of 3 to 30 Pa·s.

6. A method of processing a wire including conductors using a connection cap including an insulative cap body for receiving conductors provided with a back wall and an opening at respective opposite ends thereof; an electrically-conductive conductor connection member which is provided within the cap body; and an electrically-conductive resin material which is filled in a back wall-side portion of the cap body, the method comprising the steps of:

inserting the conductors into the cap body; and compressing the cap body by a rotary swaging machine so that the conductor connection member is retained to the cap body and is pressed fastened to the conductors, whereby the conductors are connected to the connection cap.

7. The method according to claim 6, wherein the connection cap is compressed while the connection cap is gradually inserted between opposed dies of the rotary swaging machine, with a distal end thereof first introduced therebetween.

8. The method according to claim 7, wherein the dies include, at opening-sides, tapering approach portions, respectively, and the connection cap is inserted between the dies while being guided by the approach portions.

* * * * *